United States Patent [19]

Wegel et al.

[11] Patent Number: 4,828,246

[45] Date of Patent: May 9, 1989

[54] BACK-EDGE STOP FOR SHEET STACKERS OF SHEET-FED PRESSES

[75] Inventors: Erich Wegel, Offenbach; Herbert Rebel, Rodgau, both of Fed. Rep. of Germany

[73] Assignee: M.A.N.-Roland Druckmaschinen Aktiengesellschaft, Fed. Rep. of Germany

[21] Appl. No.: 57,376

[22] Filed: Jun. 2, 1987

[30] Foreign Application Priority Data

Jun. 3, 1986 [DE] Fed. Rep. of Germany ..... 3618622

[51] Int. Cl.[4] ..... B65H 31/34; B65H 31/32; B65H 29/04

[52] U.S. Cl. ..... 271/182; 271/204; 271/218; 271/220

[58] Field of Search ..... 271/204, 207, 217, 218, 271/220, 221, 222, 223, 224, 226, 229, 182, 234; 414/35, 36, 50

[56] References Cited

U.S. PATENT DOCUMENTS

| | | | |
|---|---|---|---|
| 3,796,427 | 3/1974 | Reutter et al. | 271/204 X |
| 3,831,932 | 8/1974 | Conrad | 271/204 X |
| 3,881,722 | 5/1975 | Preuss | 271/218 |
| 3,915,317 | 10/1975 | White et al. | 271/207 X |
| 4,083,556 | 4/1978 | Schilling et al. | 271/204 |
| 4,452,442 | 6/1984 | Geschwindner et al. | 271/204 |
| 4,479,645 | 10/1984 | Pollich | 271/204 X |

FOREIGN PATENT DOCUMENTS

| | | | |
|---|---|---|---|
| 3127540 | 6/1982 | Fed. Rep. of Germany | 271/223 |
| 3112672 | 6/1983 | Fed. Rep. of Germany . | |
| 1415337 | 9/1965 | France | 271/204 |
| 633818 | 2/1962 | Italy | 271/221 |
| 647735 | 2/1985 | Switzerland . | |
| 1163666 | 9/1969 | United Kingdom . | |

OTHER PUBLICATIONS

"Document Stacker", Braen et al., IBM Technical Disclosure Bulletin, vol. 7, No. 8, Jan. 1965.

*Primary Examiner*—Joseph J. Rolla
*Assistant Examiner*—Edward S. Ammeen
*Attorney, Agent, or Firm*—Leydig, Voit & Mayer

[57] ABSTRACT

The invention relates to a back-edge stop in the form of a cross-member for sheet stackers of sheet-fed presses having a vertically positionable intermediate stacker which forms a relatively large stack, the cross-member being pivotally connected to the sheet brake by way of a link parallelogram support. A sheet brake has disposed on it fixed sheet stops and at least one further fixed sheet stop having a recess in which a brush is pivotally mounted, the bristles of the brush being inclined forwardly and downwardly and extending into the major surface of the stack a distance substantially equivalent to the difference in sheet size. As the intermediate stacker rises and falls, the brush is pivoted, by way of an inclined cam surface on the cross-member, this surface being connected non-positively to engage an actuating edge of the brush to make a controlled pivoting movement around a horizontal axis extending transversely to the direction of sheet movement.

4 Claims, 3 Drawing Sheets

BACK-EDGE STOP FOR SHEET STACKERS OF SHEET-FED PRESSES

FIELD OF THE INVENTION

The present invention relates to a back-edge stop for sheet stackers of sheet-fed presses.

BACKGROUND OF THE INVENTION

It is known that a stack of sheets, when the sheets are delivered by high-output presses, grows rapidly, especially when relatively thick materials such as cartons are being used. However, since the stacker has a limited capacity, the stack has to be changed more than once during the printing of a run. To enable the press to run with a very high output despite stack-changing, intermediate stackers have been devised. These stackers are used for stack-changing while the press continues to run and serve to provisionally stack the printed sheets during stack-changing. The present invention relates to an improvement in a device such as disclosed in DE-PS No. 31 12 672, which is the priority application for U.S. Pat. No. 4,452,442 to Geschwindner et al., the details of which are incorporated herein by reference. In brief summary, in such a device, when sheets are deposited on a vertically lowerable intermediate stacker, the rear edge of the sheets are aligned so that no edge displacement can occur when the stack is transferred to the main stack. A sheet stop is in the form of a cross-member and is pivotally connected by a link parallelogram support to the sheet brake, thus extending the lift of the intermediate stacker.

A disadvantage in such a device is that it becomes difficult to build a stack with the edges properly adjusted when sheets of different sizes are present. When the cross-member type stop is adjusted to the shortest sheet, there is a risk of longer sheets sticking, thereby raising the possibility that disturbances to non-stop operation may result. Yet when the stop is adjusted to accommodate the longest sheet which, for example, is 3 mm longer than the shortest one, the stack edges become untidy and inaccurate. This may lead to disturbing differences in contact in further processing in automatic punching machines or the like.

According to DE-OS No. 31 127 540, aligning devices for sheet deliveries of printing presses have stationary and moving sheet stops, in which the moving stops consist of brushes having soft bristles. However, this publication does not disclose an intermediate stacker which can be raised and lowered to form a relatively large stack and, more particularly, which is of use for dealing with thick carton material. Another disadvantage is that due to the presence of the brushes on both sides of the delivered sheets, the relative alignment of the front edge is bound to be uncertain because of lateral recoil of the bristles caused by previously deposited sheets. Also, the sheet may be impeded on both sides from dropping through freely. Yet another disadvantage is the costly drive needed to rotate the laterally positioned brushes.

OBJECTS AND SUMMARY OF THE INVENTION

It is therefore an object of this invention to provide a device adapted to produce accurately arranged stack front edges without preventing the sheets from dropping through freely during non-stop operation of the stacker with increased capacity.

In one aspect of the invention, there is provided a back-edge stop for a stacker which includes a positionable intermediate stacker; an adjustable sheet brake carrying fixed sheet stops, where at least one fixed sheet stop has a recessed pivotally mounted brush; an adjustable back-edge stop; and a cross-member connected to the sheet brake which acts to direct the movement of the recessed brushes on the fixed sheet stops. As the intermediate stacker rises and falls, the brush is pivoted by way of an inclined cam surface on the cross-member, this surface being connected non-positively to engage an actuating edge of the brush to cause a controlled pivoting movement around a horizontal axis transversely to the direction of sheet movement.

The advantage of the device is that it produces a sheet stack with a more uniform front edge for delivery to a subsequent process, and does so in non-stop operation with increased capacity.

These and other features and advantages of the invention will be more readily apparent upon reading the following description of a preferred exemplified embodiment of the invention and upon reference to the accompanying drawings wherein:

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAIL DESCRIPTION OF THE PREFERRED EMBODIMENTS

Turning now to the drawings, the back-edge stop for sheet stackers of sheet-fed presses of the present invention is an improvement on the stacking device disclosed in the aforementioned U.S. Pat. No. 4,452,442 to Geschwindner, which is incorporated herein by reference. Suffice it to say here that in such a device sheets 9 are carried by grippers 8 on a suitable chain conveyor along the sheet delivery path 1, and are deposited in a stack 6 below the stacker mechanism indicated generally at 4.

Figure 1:
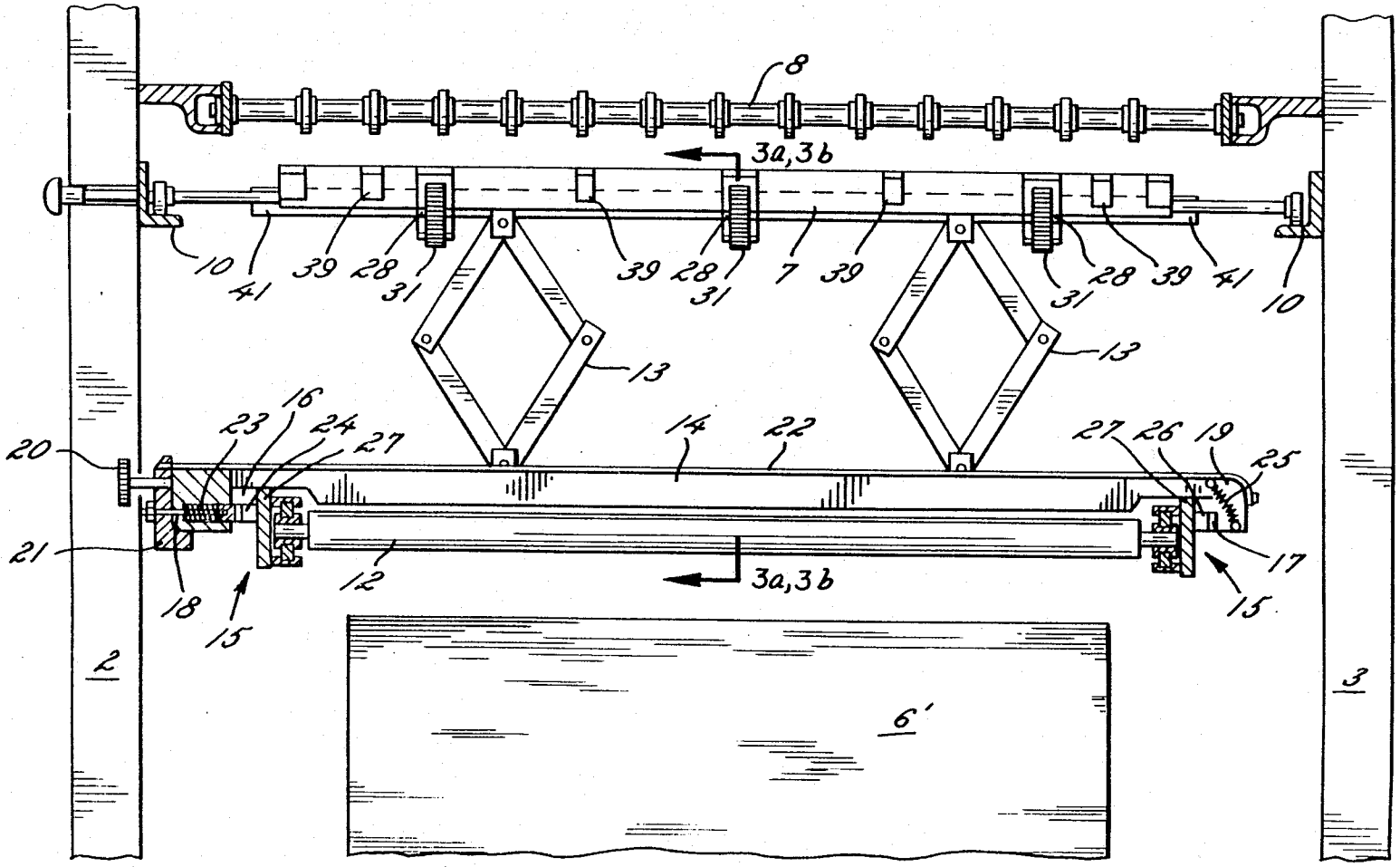
FIG. 1 is a partial sectional view of the sheet stacker of a sheet fed rotary press, comprising an intermediate stacker for non-stop operation.
Figure 2:
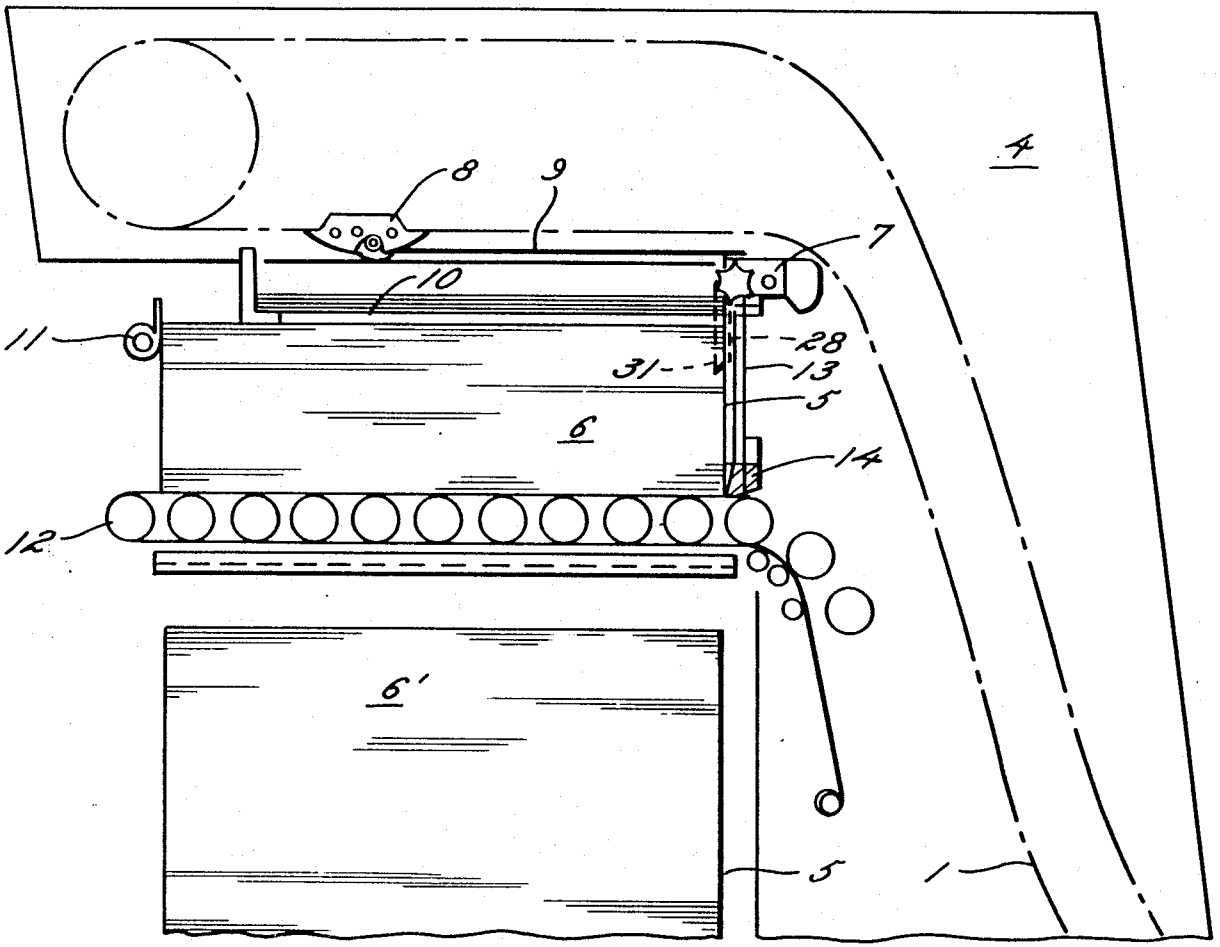
FIG. 2 is a side view corresponding to FIG. 1.

A sheet brake 7 is disposed near the sheet-delivery path 1 between frame walls 2 and 3 of the sheet stacker 4 and near the sheet back-edge 5 of a stack 6 of sheets (FIGS. 1 and 2). This allows for braking sheets 9 delivered by the chain grippers 8 so that the sheets 9 are deposited accurately on a stack 6. The brake 7 is adjustable so that various sheet formats can be deposited with their edges disposed accurately one above another. The walls 2 and 3 have toothed rails 10 on which the brake 7 is guided, and can be moved by means of a geared drive. Also, an intermediate stacker 12 is disposed between the walls 2 and 3. The intermediate stacker 12 can be raised and lowered to form a relatively large stack of sheets. This is especially advantageous when it is necessary to process thick carton material. Two link parallelogram supports 13 are pivotally connected to the brake 7 at a predetermined distance from one another, and a cross-member 14 longer than the width of the stack 6 or 6' is disposed on the supports 13.

In accordance with the present invention, means are provided for accurately and automatically maintaining the back edges of the sheets in registry as the intermediate stacker is lowered. To this end brake 7 has secured to it fixed sheet stops 39 and one or more recessed fixed sheet stops 28 oriented transversely to the direction of sheet movement. The recesses receive brushes 31 mounted in a mounting 36 for pivoting transversely to the direction of sheet movement around a horizontal axis 33. The mounting 36 is secured to a traverse member 41 of the brake 7. The mounting 36 is formed with a bore for a pivot pin 37 secured by way of a square portion to mounting 35 of brush 31. The brush 31 has forwardly and downwardly inclined bristles 30 whose angle of inclination, alpha or $\alpha$, is at least 30° and which extend into the largest surface of the stack, as can be seen in FIG. 3.

Figure 3A:
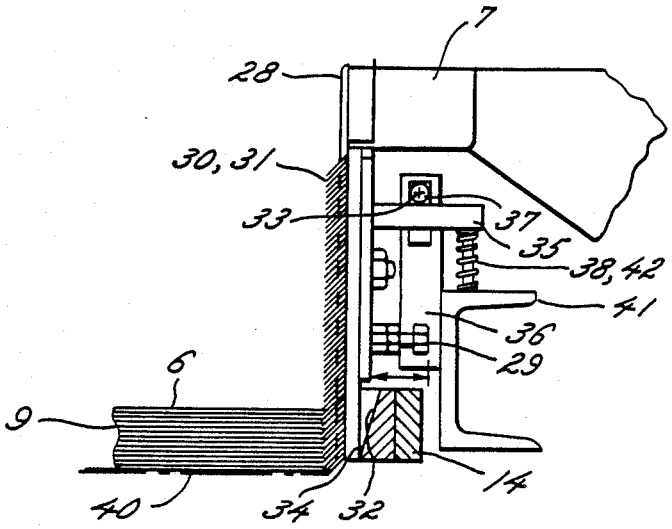
FIGS. 3*a* and 3*b* are enlarged sectional views on the line A—A of FIG. 1, showing details of two phases occurring in intermediate stacking.
Figure 3B:
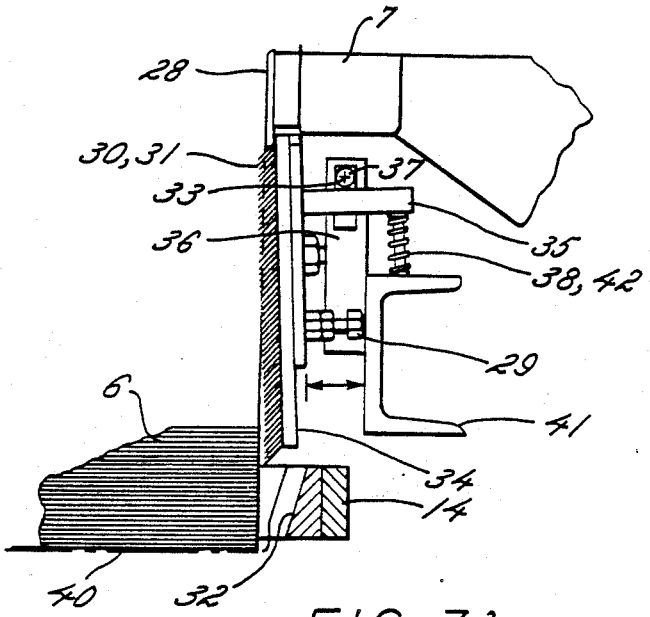

When the intermediate stacker 12 descends, the brush 31 pivots from its normal position, shown in FIG. 3*a*, to the position shown in FIG. 3*b*. A spring 38, which is guided on a spring pin 42, and which bears at one end on the traverse member 41 and at the other end on the mounting 35, biases the brush 31 so that a cam 34 engages operatively with an inclined cam surface 32 of the cross-member 14. When the intermediate stack rises, the brush 31 pivots back into its normal position. The pivoting movement can be adjusted by way of the stop 29 engaging the traverse member 41.

Since the stack 6 is lowered after the deposit of virtually every sheet 9 in carton printing, control of the adjustable brush 31 with its downwardly inclining bristles 30 engaging in the largest surface of the stack ensures that clean and sharp stack front edges are produced in non-stop operation. This is completed with an intermediate stacker 12 of the kind hereinbefore referred to, even though for reasons of cost it is necessary to process sheets 9 differing in size from one another, for example, by 3 or more millimeters. The inclined bristles 30, which act uniformly on the back-edge of the sheets 9, align them gently and resiliently relative to the front fixed sheet stop 11. The shorter sheets 9 drop through freely, while the longer sheets must first overcome the resilient resistance of the bristles 30. Also, the controlled continuous pivoting action of the brush 31, as the intermediate stacker 12 rises and falls, produces an increasing inclination of the bristles 30 which gradually reduces the resilient resistance of the brush 31. Consequently, the sheets 9 drop through freely in non-stop operation even though the stack 6 may increase rapidly. The length and strength of the brushes 30 and their controllable inclined position should be such that they retain sufficient thrust to urge the sheets against the front edge stops 11.

Also in further keeping with the invention, when the stack 6 is transferred from the intermediate stacker 12 to the main stack 6', the sheet back-edge 5 of the stack 6 is supported so that an accurate stack is provided after the transfer operation. The cross-member 14 is placed on the frame 15 of the intermediate stacker 12 and has locking elements 16 and 17 for locking the cross-member 14 to the frame 15 (FIG. 2).

The locking elements 16 and 17 are disposed on the end faces of the cross-member 14 and are formed on the operative side of as resilient toothed pins 18. On the opposite side, a pivotable toothed locking lever 19 is provided. The elements 16 and 17 are actuated by way of an adjusting screw 20, which can be screwed into a retaining plate 21 and which bears on the cross-member 14. The pin 18 is secured to the plate 21 and is guided into the end face of the cross-member 14. The two elements 16 and 17 can be interconnected, for example, by way of a steel band or strip 22, and can be actuated together by way of the screw 20. Screwing in the screw 20 moves the plate 21 away from the cross-member 14 against the force of the spring 23 and disengages the pin 18 from a toothed strip 24 secured to the frame. Also, by means of the steel strip 22, the toothed lever 19 on the opposite side is pivoted against the force of the spring 25 and disengaged from the teeth of the toothed strip 26. By adjustment of the sheet brake 7, the device can be adjusted to any required sheet format.

Since the cross-member 14 is suspended so as to be free to move along its vertical axis, and since it is supported on the frame 15, the back-edge of the stack can be supported over the entire lift range of the intermediate stacker 12. Also, the use of controlled brushes 31 to compensate for sheet differences enables a stack to be built up with sharp edges despite difference sheet sizes. For ready adjustment of the support of the brake devices 7, the cross-member 14 has rollers 27 guided on the intermediate stacker frame 15. The intermediate stacker has a top edge 40.

We claim as our invention:

1. A back-edge stop for sheet stackers of sheet-fed presses having a positionable intermediate stacker for receiving and holding sheets during stack changing, said back-edge stop comprising:

an adjustable sheet brake having fixed sheet stops transversely mounted to a direction of sheet movement, at least one of said fixed sheet stops having a recess for receiving brushes pivotally mounted for swinging movement around a horizontal axis transverse to the direction of sheet movement, said brushes having bristles of firm texture directed in a forwardly and downwardly inclined angle;

a cross-member connected to said sheet brake by a vertically adjustable support, and a transverse member coupled with said pivotally mounted brush through a spring and brush mounting, said brush pivoting being controlled by an inclined cam surface on said cross-member and a cooperating edge on said brush mounting, whereby said brush pivots automatically to maintain the back edges of said sheets in registry as said intermediate stacker is vertically lowered.

2. The back-edge stop of claim 1, wherein said downwardly inclined angle of said bristles is at least 30° with respect to the horizontal.

3. The back-edge stop of claim 1, wherein the movement of said pivotally mounted brushes is limited by an adjustable stop.

4. The back-edge stop of claim 2, wherein the movement of said pivotally mounted brushes is limited by an adjustable stop.

* * * * *